United States Patent [19]

Åström

[11] Patent Number: 4,589,264

[45] Date of Patent: May 20, 1986

[54] TUNNEL FREEZER

[76] Inventor: Sture Åström, Byalagsgatan 36, Helsingborg, Sweden, S-252 60

[21] Appl. No.: 690,368

[22] Filed: Jan. 9, 1985

Related U.S. Application Data

[63] Continuation of Ser. No. 553,969, Nov. 21, 1983, abandoned.

[30] Foreign Application Priority Data

Nov. 22, 1982 [SE] Sweden ..... 8206627

[51] Int. Cl.[4] ..... F25D 17/02

[52] U.S. Cl. ..... 62/374; 62/380

[58] Field of Search ..... 62/63, 266, 374, 375, 62/380

[56] References Cited

U.S. PATENT DOCUMENTS

| | | | |
|---|---|---|---|
| 3,287,932 | 11/1966 | Schlemmer, Jr. | 62/380 |
| 3,403,527 | 10/1968 | Berreth et al. | 62/266 |
| 3,427,820 | 2/1969 | Hart | 62/380 |
| 3,813,895 | 6/1974 | Klee et al. | 62/266 |
| 3,892,104 | 7/1975 | Klee et al. | 62/380 |
| 4,229,947 | 10/1980 | Klee et al. | 62/374 |

*Primary Examiner*—Ronald C. Capossela

*Attorney, Agent, or Firm*—Ziems, Walter & Shannon

[57] ABSTRACT

Tunnel freezer for freezing products which are transported through the tunnel freezer from an infeed end to an outfeed end. Close to the outfeed end of the tunnel spray nozzles are provided for spraying the products with liquified nitrogen or similar cryogenic liquid. The tunnel comprises circulation fans positioned upstream of the nozzles. The circulation fans comprise at least one paddle wheel positioned immediately above the products. The paddle wheel has paddles, the radial length of which is 20 to 60%, preferably 50%, of the radius of the fan wheel. Preferably also a fan wheel is arranged below the conveyor between the two paths of the conveyor, whereby the paddle wheel is driven by e.g. a chain or belt transmission. Moreover, the tunnel is divided in compartments by partitions, whereby the partition positioned at the infeed end of the fan wheel is positioned closer to the fan wheel than the partition which is positioned at the outfeed end of the fan wheel. The partitions are curtains which are made of a flexible material, such as glass fibre reinforced Teflon ® (polytetrafluoroethylene).

8 Claims, 9 Drawing Figures

TUNNEL FREEZER

This application is a continuation of application Ser. No. 553,969, filed Nov. 21, 1983, now abandoned.

The present invention relates to a tunnel freezer for freezing products using liquified nitrogen or alternatively liquified carbon dioxide.

Such a previously known tunnel freezer comprises a cover which encloses a conveyor for the products to be frozen. Close to the outfeed end of the tunnel, there are provided spray nozzles which emit a cryogenic liquid such as liquified nitrogen, which in the following will be designated LIN, on the products to be frozen. The nitrogen is quickly evaporated and fed towards the infeed end of the tunnel in a counter-current flow in order to cool the products before spraying. The nitrogen is circulated around the products by means of fans. The tunnel may be divided into several separate compartments by means of partitions, which make it possible to maintain a temperature gradient towards the infeed end of the tunnel. The counter-current flow is provided by creating a negative pressure adjacent the infeed end of the tunnel. The supply of LIN for spraying of the products is controlled by check valves in dependence on the temperature in different portions of the tunnel, which is monitored by temperature sensors. The tunnel is accessible for cleaning by the fact that the cover can be lifted upwards as a unit by means of suitable movement means, whereupon cleaning and defrosting can take place. Alternatively, the floor and the conveyor can be sinkable.

This previously known tunnel and other similar tunnel freezers have several drawbacks, e.g. the fact that the liquified nitrogen which is sprayed on the products is not completely utilized for freezing the products, the fact that the fans which are to circulate the nitrogen around the products, lose their efficiency when they are covered with ice and frost, and the fact that it is difficult to maintain a correct gas balance so that an efficient and useful counter-current heat exchange can be achieved. The object of the present invention is to solve those problems.

Previously, such fans have been constructed in accordance with two different principles. In the first instance, the fan was an axial fan having great diameter and in the second instance the fan was a radial fan having smaller diameter. According to the first-mentioned principle, the fan blades are tilted and blow the nitrogen downwards against the product on the conveyor in a closely defined gas flow. Since it was desired to place the drive motor outside the tunnel freezer and to use a short shaft, the fan wheel or the propeller was placed close to the ceiling of the tunnel, which entailed the gas flowing downwards being spread considerably before it hit the product. Moreover, said flow had a decrease velocity. The operation was acceptable. However, very soon the propeller was covered with a frost layer, which changed the shape of the propeller so that the gas flow downwards was changed to a radially directed gas flow, as shown in FIG. 2. In this case, the nitrogen is sucked upwards towards the middle of the propeller and is fed radially outwards, which creates a flow which is opposite to that intended. However, the function is maintained, but the efficiency is decreased.

In certain machines, the propeller was replaced by a radial fan comprising a fan wheel having a smaller diameter. The fan wheel was considerably less sensitive to ice and frost build-up but since the fan wheel was positioned close to the ceiling of the tunnel spaced from the product, the turbulence at the surface of the product was still small.

According to the present invention a fan wheel is provided comprising essentially radial blades or vanes which leave a free space at the middle of the fan wheel. Thus, the blades have a limited radial length, e.g. about half the radius of the fan wheel. The fan wheel is placed immediately above the products on the conveyor. The fan operates so that the nitrogen between the blades of the fan is forced radially outwards due to the centrifugal force such as takes place in a common radial fan. Thus, there is created a negative pressure at the middle of the fan wheel, which essentially is filled out by nitrogen from above. Thus, the nitrogen flows downwards in a swirl. Said swirl partially proceeds axially beyond the fan wheel and reaches the product. At the same time, the blades create a turbulence, which forces the nitrogen to contact the product. Thus, heat transfer efficiency is improved because the products are in the zone of turbulence created by the blades and the turbulent gas contacts the products while it is still under the influence of the blades. The operation of the blades is comparatively insensitive to frost build-up. The fan wheel is driven by means of a long shaft from a motor positioned at the ceiling of the tunnel.

The present invention also relates to an improvement of the gas balance and to the maintenance of a temperature gradient along the tunnel. By the gas balance, it is intended that the flow of nitrogen towards the infeed end is in balance with the supply of LIN so that no nitrogen flows out at the outfeed end and so that no surrounding air flows into the tunnel at both ends. If this is achieved, the feeding of LIN is in equilibrium with the outfeed of the nitrogen at the infeed end, while essentially no gas flows in or out at the outfeed end.

For this object, the tunnel is divided into several compartments or spaces by means of flexible curtains. The curtains can be made of glass fibre reinforced Teflon® and are flexible, which means that the frost build-up is limited since the curtains always are moving and figuratively speaking shake off the frost when it has grown to a certain thickness. Moreover, the curtains are arranged so that the curtain which is placed at the outfeed end of the fan wheel is placed at a greater distance from the fan wheel than the curtain at the infeed end. In this way, the fan wheel will provide a somewhat higher pressure at the slit below the curtain at the infeed end compared to the slit below the curtain at the outfeed end. In this manner, a controlled and forced flow of gas in the desired direction can be maintained, whereby a good gas balance can be achieved by controlling the velocity of the fan.

The invention is described in more detail below by reference to the appended drawings.

Figure 1:
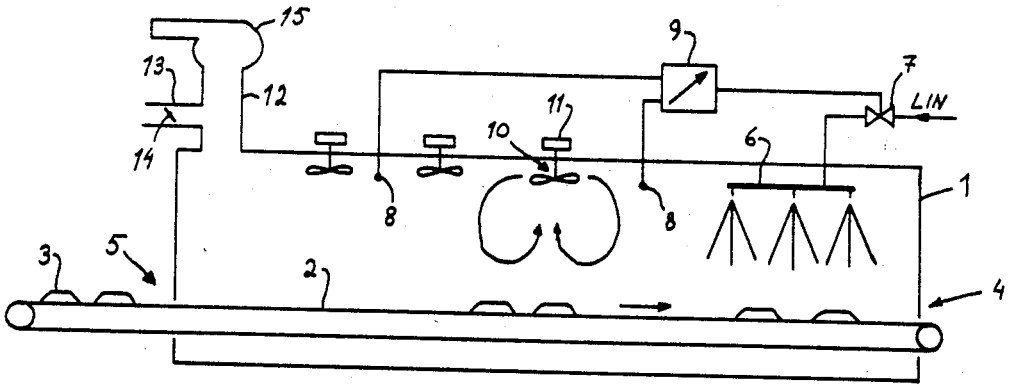
FIG. 1 is a cross-section elevation view which schematically shows the principal construction of a previously known tunnel freezer for LIN.

FIG. 1 shows a freeze tunnel according to a previously known technique in which the present invention can be applied. The tunnel comprises a cover 1 which is made of a suitable insulating material and surrounds the tunnel at four sides. A conveyor 2 forms the inner floor of the tunnel and transports the products 3, which are to be frozen from the left to the right of FIG. 1. The ends of the tunnel can be provided with suitable covers or curtains. Immediately before the outfeed end 4 of the tunnel, several spray nozzles 6 are arranged which are supplied with liquified nitrogen, LIN, through check valves 7 in order to atomize and spray LIN on the products 3 passing there below. Upon contact with the product the nitrogen is quickly evaporated and is forced essentially to the left in FIG. 1 in order to form a counter-flow in relation to the products 3, which are transported on the conveyor. Some of the liquified nitrogen flows beside the products down to the conveyor and can be recovered.

One or several temperature sensors 8 monitor the temperature at predetermined positions of the tunnel and control through suitable control circuits 9 the check valve 7 for supply of the correct amount of LIN via the spray nozzels 6. One or several circulation fans 10 are arranged adjacent the ceiling of the tunnel and are driven by electric motors 11.

At the infeed end there is provided an exhaust channel 12 comprising an exhaust fan 15, which sucks nitrogen from the tunnel and forms the required negative pressure in order to generate the counter-flow. Before it is fed to the exhaust fan 15, the cold nitrogen, which still can have a temperature of about −30° C., is mixed with surrounding air provided through the side channel 13, which comprises a manually adjustable valve 14. This fact prevents frost build-up at the fan 15 and in the channels under certain conditions.

Figure 2:
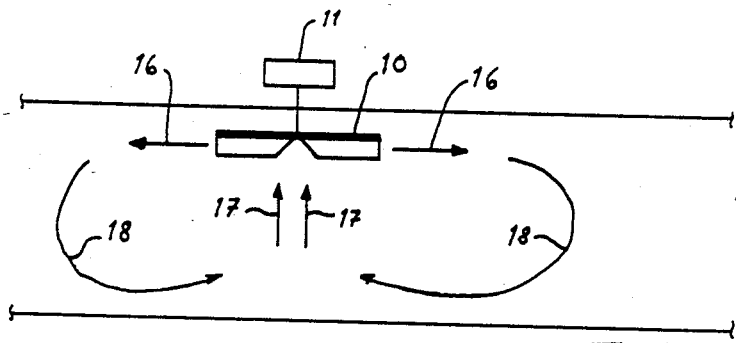
FIG. 2 is a schematic elevation view similar to FIG. 1 and shows the gas flow at the fan wheel of the tunnel according to FIG. 1.

FIG. 2 shows the gas flow for the circulation fan 10 in the previously known equipment according to FIG. 1. The fan wheel 10 can be any type of transportation fan having radial or essentially radial blades. The gas between the blades is expelled radially outwards as indicated by the arrows 16, which creates a negative pressure at the middle of the fan wheel. The gas below the fan wheel will be sucked upwards as indicated by arrows 17, whereby the circulation path shown by arrows 18 is achieved.

Figure 3:
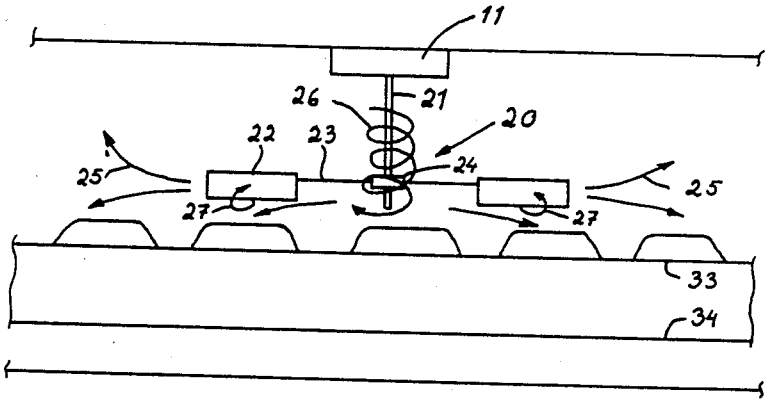
FIG. 3 is an elevation view similar to FIG. 2 and shows the gas flow of a fan wheel according to the present invention.

FIG. 3 shows a fan wheel 20 according to the present invention. The fan wheel 20 is attached to a shaft 21, which extends from the electric motor 11. The fan wheel 20 comprises blades or paddles 22 having a limited radial extension. The paddles are attached to a hub 24 by means of spoke-like wires 23. The number of paddles is without any significance for the present invention, but as an example four paddles are mentioned. The fan wheel 20 is placed immediately above the products 3 in order to more directly influence the surface of the products. The hub can be displaceable on the shaft in order to raise and lower the fan wheel for products having different heights.

The gas flow achieved for the nitrogen can be seen from the arrows in FIG. 3. The nitrogen between the paddles 22 is forced radially outward as indicated by arrows 25. Thus, there is created a negative pressure at the middle of the paddle wheel, which is filled out from above and also to a certain degree from below the conveyor. The nitrogen flowing downwards is imparted a swirl motion as indicated by the arrow 26. This swirl proceeds partially axially downwards and reaches the product 3 on the conveyor. Adjacent the paddles there are also created local swirls or turbulence as indicated by arrows 27. Thus, it is clear that the gas area adjacent the fan wheel is fluctuating and turbulent, which entails an efficient heat transfer.

The diameter of the fan wheel 20 is preferably close to but somewhat less than the width of the conveyor. As previously mentioned, preferably several such fan wheels are arranged along the length of the conveyor. The fan wheels are rotated in opposite directions so that the first fan wheel is rotated clockwise, the second fan wheel is rotated counterclockwise, the third is rotated clockwise, etc.

Figure 4:
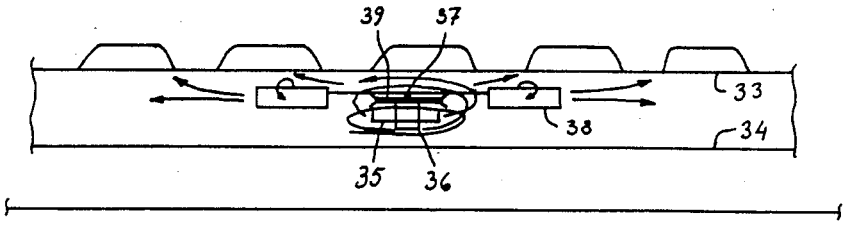
FIG. 4 is an elevation view similar to FIG. 3 and shows the arrangement of a fan wheel below the conveyor.

According to the invention, one or several fan wheels can also be placed below the products between the paths of the conveyor as shown in FIG. 4. Between the paths 33 and 34 of the conveyor there is arranged a cross-beam 35 which at the middle thereof supports a bearing 36 for a shaft 37. The shaft 37 supports several paddle blades 38 of the type mentioned above. On the shaft there is also placed a pulley or sprocket 39, which is driven by a belt or a chain from the side of the tunnel. Due to the low speed of the fan wheel 37, 38, it can be placed between the paths 33, 34 of the conveyor and still a sufficient bearing can be provided and the driving can take place from the side of the tunnel by belts or chains or similar devices.

The fan wheel 37, 38 operates essentially in the same way as the fan wheel 20 and can be positioned exactly below the fan wheel 20 or offset in the longitudinal direction of the conveyor as desired.

Figure 5:
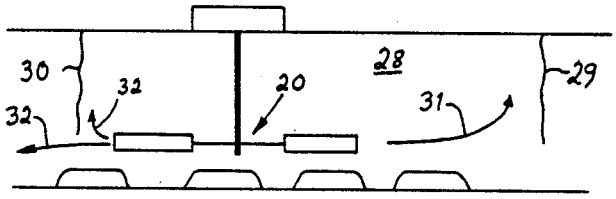
FIG. 5 is an elevation view similar to FIG. 3 and shows the placement of flexible curtains according to the present invention.
Figure 6:
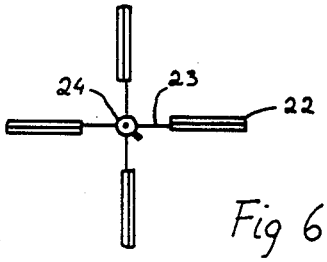
FIG. 6 is an elevation view of the fan wheel according to the invention.

As shown in FIG. 5, the tunnel freezer is divided into compartments or spaces 28 by means of flexible curtains 29, 30. The curtains are made of suitable plastic materials, e.g. glass fibre reinforced Teflon® (polytetrafluoroethylene), but also other materials are conceivable. The curtains are suspended from the ceiling of the tunnel in a suitable way. The curtains are so flexible or resilient that they always are moving due to the gas flows in the tunnel. This fact results in the frost build-up being shaken off or cracked and loosened from the curtains. As appears from FIG. 5, the left curtain 30, which is positioned closer to the infeed end 4 of the tunnel, is positioned comparatively close to the fan wheel 20, while the right curtain 29, which is positioned closer to the outfeed end 5 of the tunnel, is positioned at a longer distance from the fan wheel. This fact means that the radially directed gas flow according to the arrow 25 is deflected by the right curtain 29 according to the arrow 31, while the gas flow to the left according to the arrow 32 can take place relatively undisturbed and pass below the curtain 30. In this way there is created a trend that the gas is flowing to the left of FIG. 5, i.e. a counter-flow in relation to the movement direction of the conveyor, which is desired. In this way it is possible to maintain the necessary gas balance, which is achieved by controlling the rotation speed of the fans. It is desirable that each second fan is rotated clockwise and each intermediate fan is rotated counter-clockwise.

After the gas has left the closed space of the tunnel at the infeed end, it is sucked out in a suitable manner.

According to the invention, it is not necessary to create any negative pressure in the tunnel, which makes it possible to use a more simple construction. The gas balance is achieved according to the invention by the circulation fans 20.

Figure 9:
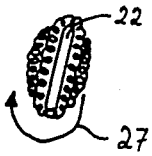
FIG. 9 is a cross-sectional view through a blade covered with ice.
Figure 7:
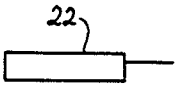
FIGS. 7 and 8 are elevation views of alternative shapes of the blades according to FIG. 6.
Figure 8:
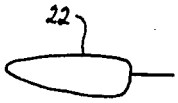

In FIGS. 6 to 9, a fan wheel 20 according to the invention is shown. The fan wheel 20 comprises several blades 22, which have an essentially radial extension. The blades are attached to spokes 23 or the like. The radial length of each blade is about half the radius of the fan wheel, but variations from 20 to 60% are conceivable. The blades or paddles 22 can be somewhat inclined as shown in FIG. 9. In FIG. 7 there are shown blades which are essentially rectangular, but in FIG. 8 the blades are somewhat rounded. As frost build-up on the blades, which is inevitable, the planar blades according to FIG. 7 achieve a shape shown in FIG. 9, which however still gives a satisfactory operation.

Here above, the principles of the present invention have been described schematically. However, the invention can be embodied in many different ways within the scope of the invention and the embodiment shown is not intended to limit the invention. The invention is only limited by the appended patent claims.

I claim:

1. A tunnel freezer for freezing products wherein the products are transported through a tunnel from an infeed end to an outfeed end by a conveyor having a preestablished width comprising:

spray nozzles adjacent the outfeed end for spraying a cryogenic liquid on the products; and means for circulating gas, said circulating means being positioned in the tunnel upstream of said spray nozzles with respect to the direction of the transportation of the products;

wherein said circulating means includes at least one paddle wheel positioned immediately above the products, the diameter of the paddle wheel being slightly smaller than the width of the conveyor, and wherein the conveyor has two paths, and at least one paddle wheel is positioned between said two paths, said paddle wheel being driven by a suitable transmission.

2. A tunnel freezer for freezing products wherein the products are transported through a tunnel from an infeed end to an outfeed end by a conveyor having a preestablished width comprising:

spray nozzles adjacent the outfeed end for spraying a cryogenic liquid on the products;

means for circulating gas, said circulating means being positioned in the tunnel upstream of said spray nozzles with respect to the direction of the transportation of the products, wherein said circulating means includes at least one paddle wheel positioned immediately above the products, the diameter of the paddle wheel being slightly smaller than the width of the conveyor; and means for dividing the tunnel into compartments, said dividing means including a first partition positioned between said paddle wheel and the infeed end of the tunnel and a second partition positioned between said paddle wheel and the outfeed end of the tunnel, wherein said first partition is positioned closer to said paddle wheel than said second partition.

3. The tunnel freezer as claimed in claim 2, wherein the partitions are curtains of a flexible material.

4. The tunnel freezer as claimed in claim 3, wherein the flexible material is glass fibre reinforced polytetrafluoroethylene.

5. Cooling apparatus for cooling products wherein the products are transported through an enclosure from an infeed end to an outfeed end by a conveyor having a preestablished width comprising;

means in said enclosure for circulating a cooling gas, wherein said circulating means includes at least one paddle wheel positioned immediately above the products, the diameter of the paddle wheel being slightly smaller than the width of the conveyor, and wherein the conveyor has two paths, and at least one paddle wheel is positioned between said two paths, said paddle wheel being driven by a suitable transmission.

6. Cooling apparatus for cooling products wherein the products are transported through an enclosure from an infeed end to an outfeed end by a conveyor comprising:

means positioned in said enclosure for circulating a cooling gas, said circulating means including at least one paddle wheel creating turbulence in said cooling gas and having a hub, a plurality of substantially radial paddles and a plurality of spokes connecting said paddles to said hub, said paddle wheel being positioned above the products and sufficiently close to the products that said turbulence contacts said products.

7. The cooling apparatus as claimed in claim 6, wherein the length of each paddle is about 20% to 60% of the radius of the paddle wheel.

8. The cooling apparatus as claimed in claim 7, wherein the length of each paddle is about 50% of the radius of the paddle wheel.

* * * * *